United States Patent [19]

Shchamorov et al.

[11] Patent Number: 4,820,383

[45] Date of Patent: Apr. 11, 1989

[54] COLLAPSIBLE PLASTIC CONTAINER

[75] Inventors: Shlomo Shchamorov, Tel-Aviv; Aharon Schnapp, Givatayim, both of Israel

[73] Assignee: Mercaz Haargazim Ltd., Tel Aviv, Israel

[21] Appl. No.: 879,961

[22] Filed: Jun. 30, 1986

[30] Foreign Application Priority Data

Jul. 29, 1985 [IL] Israel ..... 75934

[51] Int. Cl.[4] ..... B65D 6/18

[52] U.S. Cl. ..... 220/6; 220/7

[58] Field of Search ..... 220/6, 7, 343

[56] References Cited

U.S. PATENT DOCUMENTS

| | | | |
|---|---|---|---|
| 3,119,508 | 1/1964 | Wallace | 220/6 |
| 3,254,786 | 6/1966 | Melville | 220/6 |
| 3,973,692 | 8/1976 | Cloyd | 220/7 |
| 4,044,910 | 8/1977 | Box | 220/6 X |
| 4,238,044 | 12/1980 | Roddier | 220/4 |
| 4,320,845 | 3/1982 | Waller | 220/7 X |
| 4,347,941 | 9/1982 | Johansson et al. | 220/6 |
| 4,491,231 | 1/1985 | Heggeland et al. | 220/6 |
| 4,498,598 | 2/1985 | Bae | 220/6 |
| 4,508,237 | 4/1985 | Kreeger et al. | 220/6 |

FOREIGN PATENT DOCUMENTS 2068338A 8/1981 United Kingdom .

*Primary Examiner*—Steven M. Pollard

*Attorney, Agent, or Firm*—Benjamin J. Barish

[57] ABSTRACT

A collapsible plastic container comprises a pair of side walls and a pair of end walls each of plastic material formed with a plurality of air-circulation openings therethrough; and hinges mounting each end wall between a pair of side walls to form a container in which the walls are hinged for movement either to an open condition or to a collapsed condition. Each of the walls includes internally-extending bottom ledges adapted to receive a bottom wall of plastic material formed with a plurality of air-circulation openings therethrough. The side and end walls are formed with cooperable tongue and slot retainer elements to retain them in their open condition until the bottom wall is applied to the bottom ledges.

10 Claims, 6 Drawing Sheets

FIG. 6
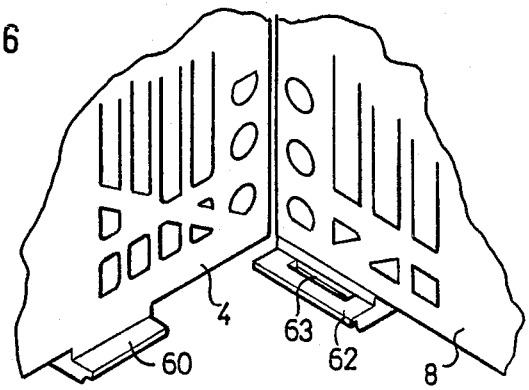
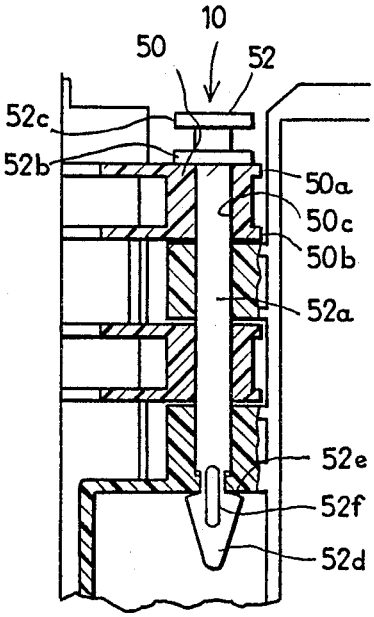
FIG. 7
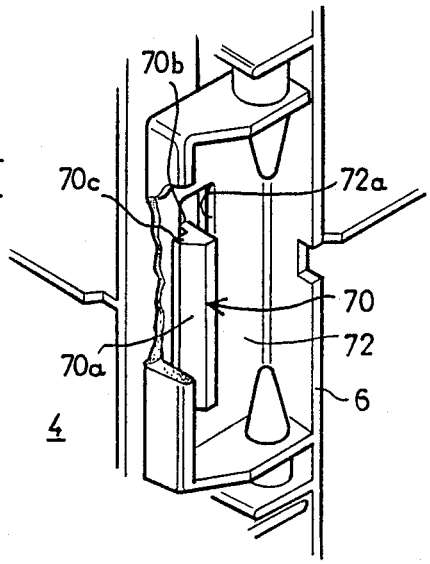
FIG. 8
FIG. 9
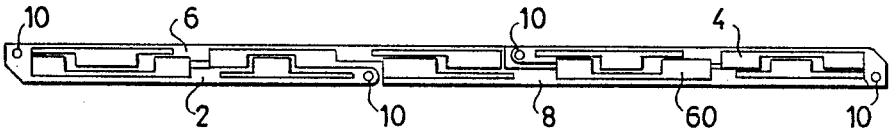

COLLAPSIBLE PLASTIC CONTAINER

BACKGROUND OF THE INVENTION

The present invention relates to a collapsible plastic container, namely to a container which can be conveniently opened for use in holding various types of goods, and also collapsed for storage or transportation.

Many types of collapsible plastic containers have been developed. Examples of such containers are illustrated in U.S. Pat. Nos. 3,547,309, 3,568,879, 3,993,211, 4,044,910, 4,238,044, 4,320,845, 4,498,598 and 4,508,237. Efforts are continuously being made to improve the containers in the following respects: facilitate their opening and closing; to increase their strength particularly against top pressure and rotary moments; increase the air-circulation through the container particularly when used for shipping produce; and decrease the weight and cost.

An object of the present invention is to provide a collapsible plastic container having advantages in some or all of the above respects.

SUMMARY OF THE INVENTION

The present invention provides a collapsible plastic container comprising a pair of side walls of plastic material formed with a plurality of air-circulation openings therethrough; and a pair of end walls of plastic material formed with a plurality of of air-circulation openings therethrough; and hinges mounting each end wall between a pair of side walls to form a container in which the walls are hinged for movement either to an open condition wherein the walls are disposed perpendicularly to each other to form a container of rectangular configuration, or to a collapsed condition wherein the walls are folded on top of each other for storage or transportation. Each of the walls includes internally-extending bottom ledges adapted to receive a bottom wall of plastic material formed with a plurality of air-circulation openings therethrough. The bottom wall is supported on the bottom ledges in the open condition of the container so as to rigidify the container, and is removable from the ledges to permit collapse of the container.

According to an important feature in the described preferred embodiment, at least one of the side and end walls is integrally formed at one end with a laterally-extending retainer tongue, and the end of the contiguous wall is formed with a retainer member having a slot adapted to receive the retainer tongue in the open condition of the container to retain the walls in their open condition until the bottom wall is applied over the bottom ledges. More particularly, each of the retainer tongues includes a cam face yieldingly engageing the side of the slot in its respective retainer member during the movement of the two respective walls to their open condition, and a shoulder which is snapped into engagement behind the edge of the slot in its respective retainer member when the two walls have reached their open condition.

According to another important feature in the described preferred embodiment, each of the side and end walls is formed with an upper series of air-circulation openings configured and dimensioned to impart high rigidity to the upper end of the wall; a lower series of air-circulation openings configured and dimensioned to impart less rigidity to the lower end of the wall; and an intermediate series of air-circulation openings configured and dimensioned to impart even less rigidity to the intermediate portion of the wall.

According to still further features, each of the hinge pins is formed with an enlarged head at one end engageable with one side of the respective hinge socket, the opposite end of each hinge pin being tapered for passing it through the hinge sockets of the contiguous walls, the tapered end of the hinge pin terminating in an annular shoulder engageable with the opposite end of the hinge sockets. In addition, each of the hinge pins is formed with a slot beginning at a point between the tip of the tapered end of the hinge pin and the annular shoulder thereof, and extending past the annular shoulder, to increase the resiliency of the tapered end of the hinge pin when inserted into the hinge sockets.

Further features and advantages of the invention will be apparent from the description below.

BRIEF DESCRIPTION OF THE DRAWINGS

The invention is herein described, by way of example only, with reference to the accompanying drawings, wherein:

FIG. 6 is a fragmentary three-dimensional view illustrating one of the corners in the container of FIG. 1;

FIG. 7 is a fragmentary view illustrating one of the hinges in the container of FIG. 1;

FIG. 8 is a fragmentary view illustrating the retainer structure for retaining two contiguous walls perpendicularly to each other when moving the container walls to their open condition;

FIG. 9 is an elevational view illustrating the container walls in their collapsed condition.

DESCRIPTION OF A PREFERRED EMBODIMENT

Figure 1:
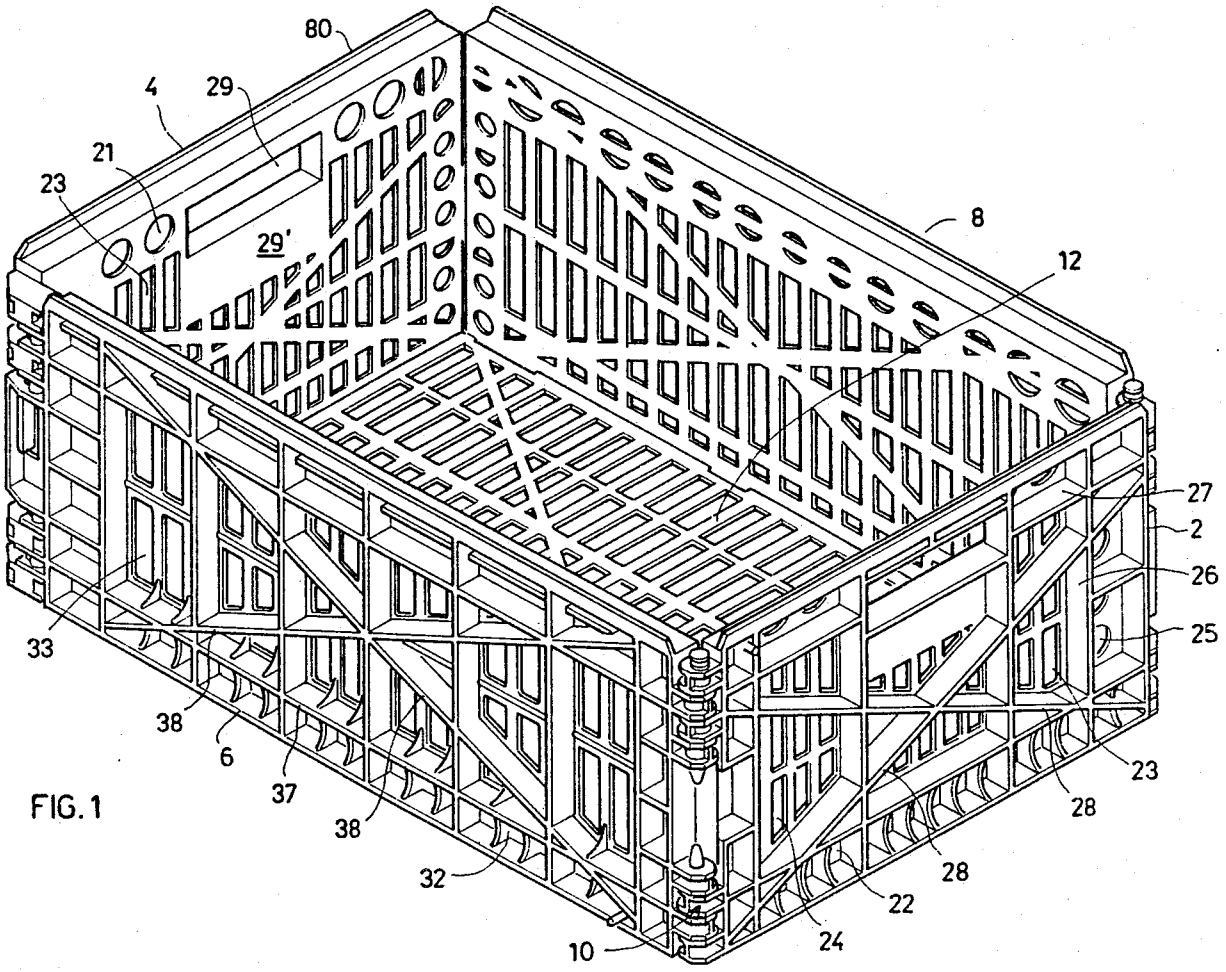
FIG. 1 is a perspective view illustrating one form of container constructed in accordance with the present invention.

The container illustrated in the drawings comprises a pair of end walls 2, 4 hingedly mounted to a pair of side walls 6, 8 by a plurality of hinges, each generally designated 10, permitting the walls to be moved to an open condition, as illustrated in FIG. 1 wherein the walls are disposed perpendicularly to each other to form a container of rectangular configuration, or to a collapsed condition, as illustrated in FIG. 9 wherein the walls are folded on top of each other for storage or transportation. In the open condition of the container, a bottom wall 12 is inserted within the two end walls 2, 4 and the two side walls 6, 8, and retains the container in its open condition; when the container is to be collapsed to its folded condition as illustrated in FIG. 9, the bottom wall 12 is removed and placed on top of the folded side and end walls.

Figure 3:
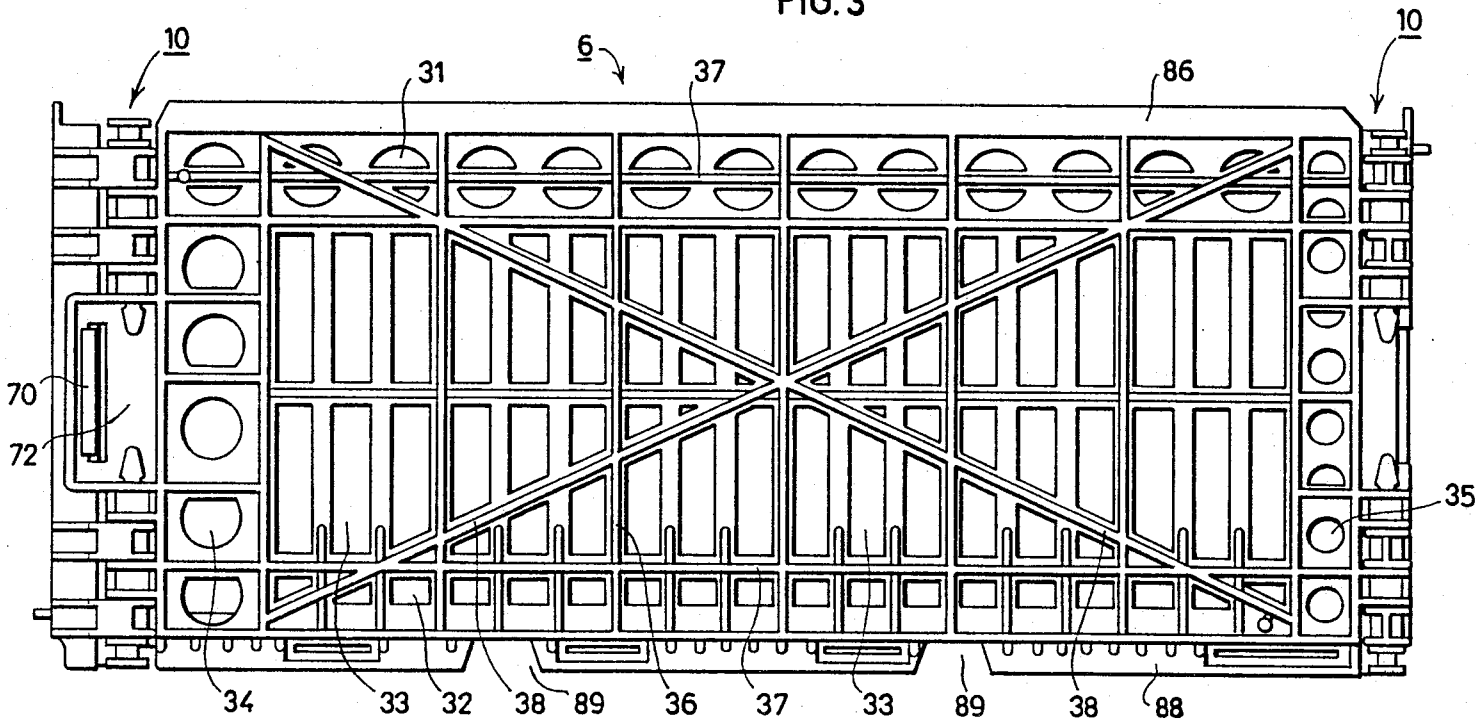
Figure 4:
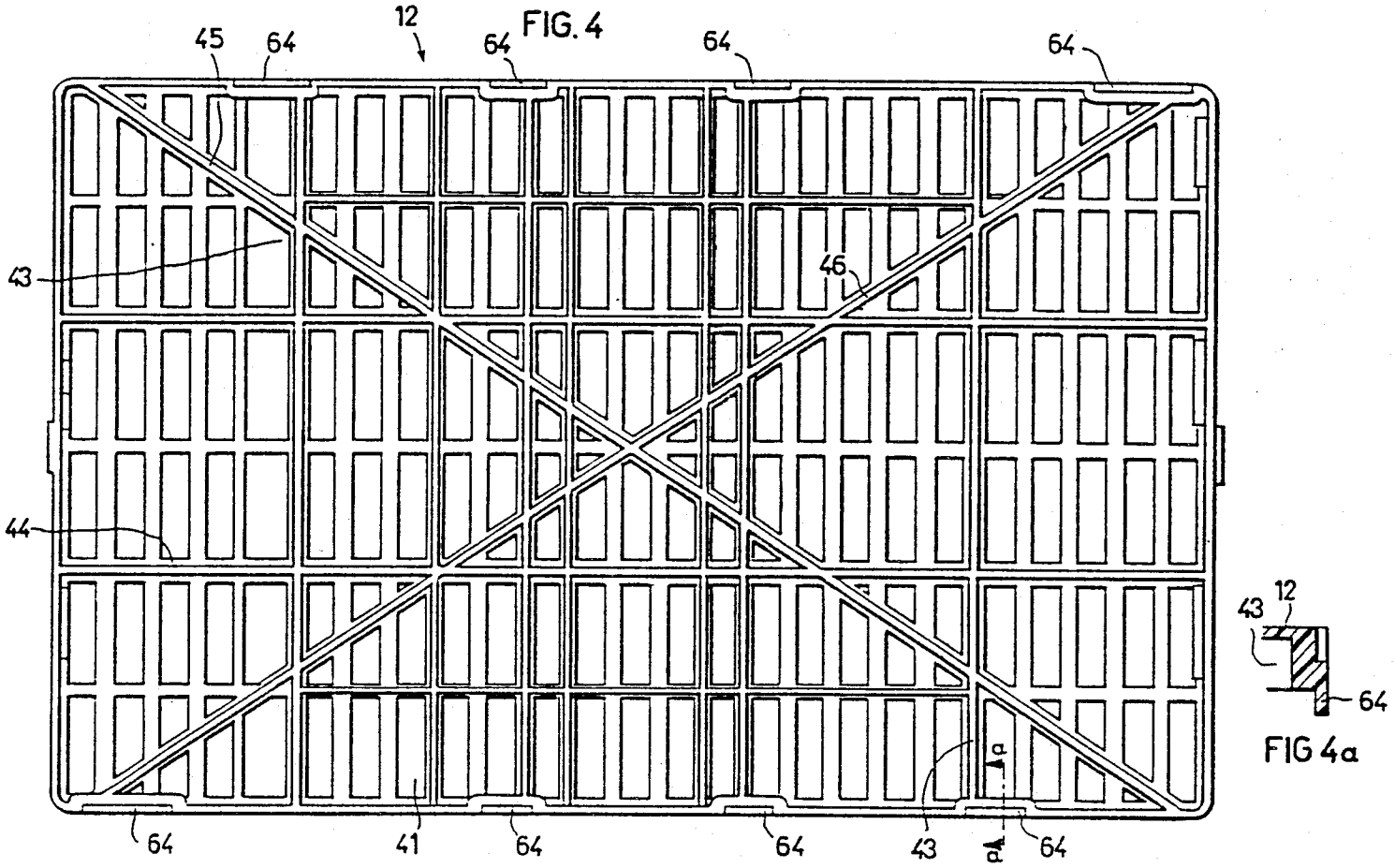
FIG. 4 illustrates the bottom wall in the container of FIG. 1, and FIG. 4*a*, is a sectional view along lines a— of FIG. 4.

All of the walls of the container are made of plastic material and are formed with a plurality of air-circulation openings therethrough. The two end walls 2, 4 are of identical construction, best illustrated in FIG. 2 with respect to end wall 4; the two side walls 6, 8 are also of identical construction, best illustrated in FIG. 3 with respect to side wall 6; and the construction of the bottom wall 12 is best illustrated in FIG. 4.

Figure 2:
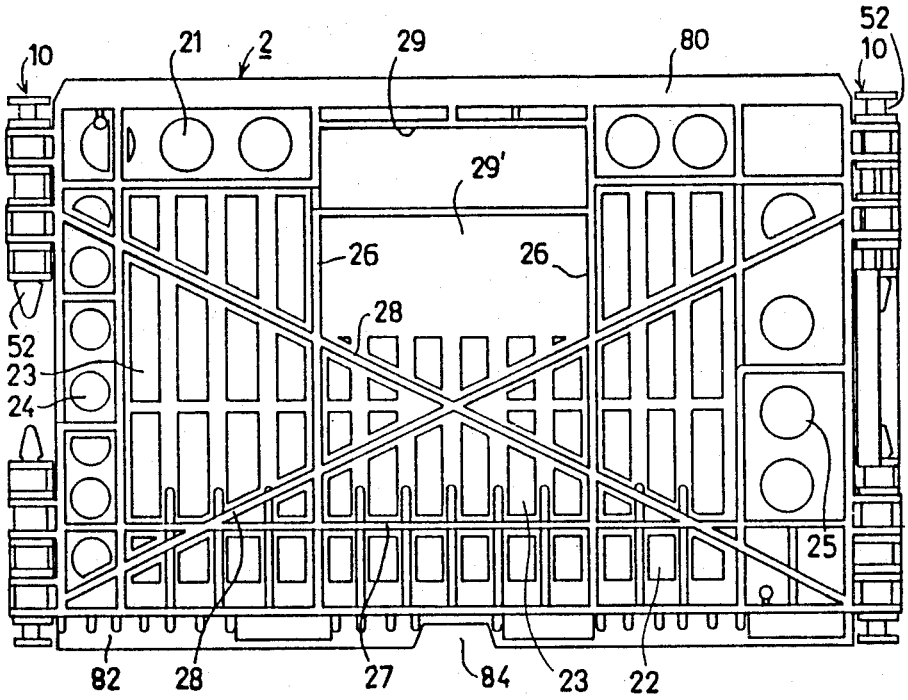
FIGS. 2 and 3 are end and side views, respectively, of the container of FIG. 1.

The two end walls 2, 4, as best seen in FIG. 2, are each integrally formed with an upper horizontal series of air-circulation openings 21 configured and dimensioned to impart high rigidity to the upper end of the wall; a lower horizontal series of air-circulation openings 22 configured and dimensioned to impart less rigidity to the lower end of the wall; and an intermediate horizontal series of openings 23 configured and dimensioned to impart even less rigidity to the intermediate portion of the wall. In addition, end wall 2 is further formed with a vertical series of openings 24, 25, at its opposite ends configured to impart high rigidity to the opposite ends of the wall. End wall is also formed with a plurality of strengthening ribs including a plurality of vertically-extending ribs 26, a plurality of horizontally-extending ribs 27, and a pair of diagonally-extending ribs 28.

In addition, the two end walls 2, 4, are each formed with a rectangular opening 29 centrally of its upper end serving as hand-grip openings to enable carrying the container when in its open condition and filled with articles. The portion 29' of each end wall 2, 4 underlying the hand-grip openings 29 is left filled with plastic to increase the rigidity thereof when a lifting force is applied.

The two side walls, 6, 8, are similarly constructed as the two end walls 2, 4, but are of longer length. Thus, as shown in FIG. 3 illustrating side wall 6, each side wall also is formed with: an upper horizontal series of openings 31, configured and dimensioned to impart high rigidity to the upper end of the wall; a lower horizontal series of openings 32 to impart less rigidity to the lower end of the wall; an intermediate horizontal series of openings 33 to impart even less rigidity to the intermediate portion of the wall; a vertical series of openings 34 along one side of the wall providing a high rigidity to that side; a vertical series of openings 35 along the opposite of the wall also providing high rigidity to that side of the wall; a plurality of vertically-extending strengthening ribs 36; a plurality of horizontally-extending strengthening ribs 37; and a pair of diagonally-extending strengthening ribs 38.

In the example illustrated in the drawings: the upper series of openings 21, 31 in the end walls 2, 4 and side walls 6, 8 are of circular configuration; the lower series of openings 22, 32 are of rectangular configuration; the intermediate series of openings 23, 33 are also of rectangular configuration but have a longer vertical dimension than horizontal dimension; the end openings 24, 34 are of circular configuration but of smaller diameter than the upper openings 21, 31; and the other end openings 25, 35 are of circular configuration of approximately the same diameter as the upper series of openings 21, 31.

The foregoing construction of the two end walls 2, 4 and the two side walls 6, 8 of the container provides the following characteristics to the container when the container is in its open condition: The upper sections of the container walls occupied by the upper series of openings 21, 31, together with the opposite sides of the container walls occupied by the end openings 24, 25 and 34, 35, impart high rigidity to the container and provide the container, when in its open condition, with maximum strength against top pressure and rotary moments. The lower sections of the container walls occupied by the lower series of openings 22, 32, impart less rigidity to the respective walls of the container since the rigidity at the lower part of the container is enhanced by the presence of the bottom wall 12 when the container is in its open condition. The intermediate portions of the container walls occupied by the intermediate openings 23, 33, imparting even less rigidity, provide these sections of the walls with yieldability to minimize the possibility of damage to the goods, such as produce, filling the container.

It has been found that a container including the side and end walls of the illustrated construction exhibits a magnitude of strength against top pressure and rotary moments approaching that of solid-wall containers. At the same time, such a container provides a surface area which is approximately 50% exposed to air, thereby enabling a high degree of air circulation through the walls, which is very important in plastic containers since plastic does not "breathe". In addition, the illustrated construction reduces considerably the weight and the cost of the container as compared to solid-wall containers.

The bottom wall 12 of the container illustrated in FIG. 4 is also formed with a plurality of air-circulation openings 41. But in this case, all the openings 41 are of substantially the same rectangular configuration. Bottom wall 12 is further formed with a plurality of strengthening ribs 43, along our axis, a plurality of strengthening ribs 44 along the other orthogonal axis, and a pair of diagonally-extending strengthening ribs 45, 46.

Each of the hinges 10 is constructed as illustrated in FIG. 7. Thus, the two contiguous walls at each hinge 10 are integrally formed with a pair of hinge sleeves 50 extending laterally of the respective wall and vertically spaced from each other so as to permit the two hinge sleeves of one wall to interfit and align with the hinge sleeves of the other wall to produce a socket for receiving the hinge pin 52. Each of the hinge sleeves 50 is formed with an annular flange 50*a*, 50*b* at its opposite ends of larger diameter than its intermediate portion 50*c*.

Each hinge pin 52 is formed with an elongated shank 52*a* received within the aligned hinge sleeves 50, with a pair of enlarged heads 52*b*, 52*c* at one end of the pin, and with a tapered end 52*d* at the opposite end to facilitate passing the pin through the aligned sleeves. Tapered end 52*d* of each hinge pin 52 terminates in an annular shoulder 52*e* at its juncture with the shank 52*a* of the pin; this annular shoulder is engageable with the outer surface of the end hinge sleeve 50 when the hinge pin is in place. In addition, the tapered end 52*d* of each hinge pin 52 is formed with an axial slot 52*f* straddling annular shoulder 52*e*, i.e., starting at a point between the tip of the tapered end 52*d* and the annular shoulder 52*e*, and extending past the annular shoulder into the juncture portion with shank 52*a*.

The purpose of slot 52*f* is to increase the resiliency of the tapered end 52*d* of the pin to enable the pin to be force-fitted through the aligned sleeves 50 until shoulder 52*e* of the pin engages the lower surface of the end hinge sleeve; and the purpose of providing the two enlarged heads 52*b*, 52*c* at the opposite end of the pin is to permit the pin to be impacted by a hammer or like instrument when forcing the hinge pin through the aligned sleeves 50 at each hinge 10.

Figure 5:
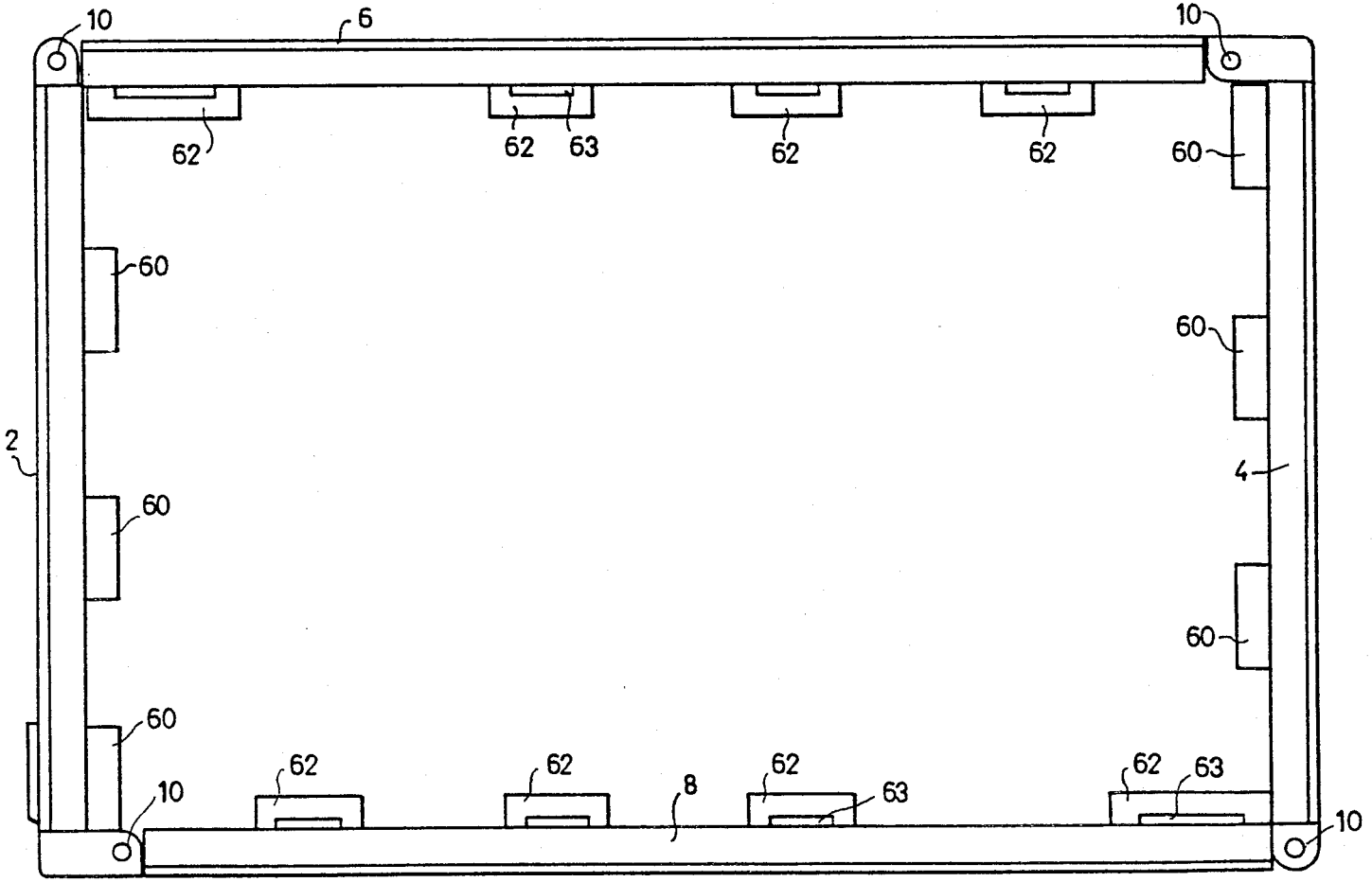
FIG. 5 is a top plan view of the container of FIG. 1 with the bottom wall removed.

As shown in FIG. 5, each of the end walls 2, 4 is formed with a plurality of inwardly-extending ledges 60 spaced along the bottom edge of the wall. Each of the side walls 6,8 is found with a plurality of similar ledges 62, but each such ledge is formed with an axial rib 64 (FIGS. 4, 4*a*) having a thickened slot 63 therethrough bordering the wall. The bottom wall 12 is in turn formed along each of its two long sides with a downwardly extending rib 64 receivable within slots 63 of the ledges 62 for releasably retaining the bottom wall in place between the end and side walls of the container when the container is in its open condition.

In order to retain the container in its open condition until the bottom wall 12 is placed into it, at least one of the walls 2, 4, 6, 8 is integrally formed at one end with a laterally-extending retainer tongue, and a contiguous wall is integrally formed with a retainer member having a slot adapted to receive the retainer tongue in the open condition of the container. In the example illustrated in the drawings, the retainer tongue, shown at 70 in FIG. 3, is provided at one end of each of the two end walls 2, 4; and the slotted retainer member, shown at 72 in FIG. 3, is provided at the contiguous end of each of the two side walls 6, 8.

The construction and mode of operation of the above-described retainer members are more particularly illustrated in FIG. 8. Thus, retainer tongue 70 is formed with a cam face 70*a* which, because of its yielding connection 70*b* to the end wall (2, 4), yieldingly enagages the edge of the slot 72*a* in the retainer member 72 integrally formed at the end of each side wall 6, 8. When the four walls 2, 4, 6 and 8 are moved with respect to each other when opening the container, cam surface 70*a* of tongue 70 first engages the edge of slot 72*a* of retainer member 72 and yields during the continued movement of the walls because of the yielding connection 70*b* of the tongue, until the walls are brought perpendicularly to each other; at this time shoulder 70*c* formed at the juncture of tongue 70*a* and its yieldable connection 70*b* to its wall, snaps into engagement with the edge of slot 72*a*. The tongues 70 thus retain the four walls 2, 4, 6 and 8 perpendicularly to each other in the open condition of the container until the bottom wall 12 is inserted on top of the ledges 60, 62. When the bottom wall has been so inserted, it firmly retains the four walls in their open condition.

It will thus be seen that the illustrated container may be opened for use by merely spreading the end walls 2, 4 and the side walls 6, 8 apart until tongues 70 are snapped into the slots 72*a* in the retainer members 72 of the contiguous walls. The bottom wall 12 may then be placed over the ledges 60, 62 of the side and end walls 2, 4, 6 and 8, and ribs 64, inserted into slots 63 of ledges 62. The ledges thereby retain the bottom wall in place even though the empty container is moved or inverted. A rigid container structure is thus provided for containing all types of products.

When the container is no longer to be used, bottom wall 12 is manually removed, and the remaining four walls 2, 4, 6 and 8 are manually forced towards each other. This is permitted by the yieldability of junctures 70*b* of tongues 70*c* with respect to their walls. The walls are then moved to their collapsed condition as illustrated in FIG. 9, thereby providing a compact assembly for storage or transportation.

As shown particularly in FIG. 2, each of the two end walls 2, 4 is formed with an upstanding rib 80 extending along the complete length of its upper edge, and with a further rib 82 extending along its lower edge. Rib 82 is formed with a trapezoidal recess 84 midway of the length of the wall. As shown in FIG. 3, each of the two side walls, 6, 8 is similarly formed with a rib 86 extending the complete length of its upper edge, and with a lower rib 88 extending along its lower edge; the lower ribs 88, however, are formed with two trapezoidal recesses 89 spaced at one-third and two-thirds, respectively, of the length of the wall. These ribs and recesses permit a plurality of like containers to be stacked on top of each other in a plurality of layers with the containers of each layer straddling a pair of containers of the underlying layer, and with the ribs of the underlying layer, received in the recesses of the overlying layer to stabilize the stack.

Figure 10:
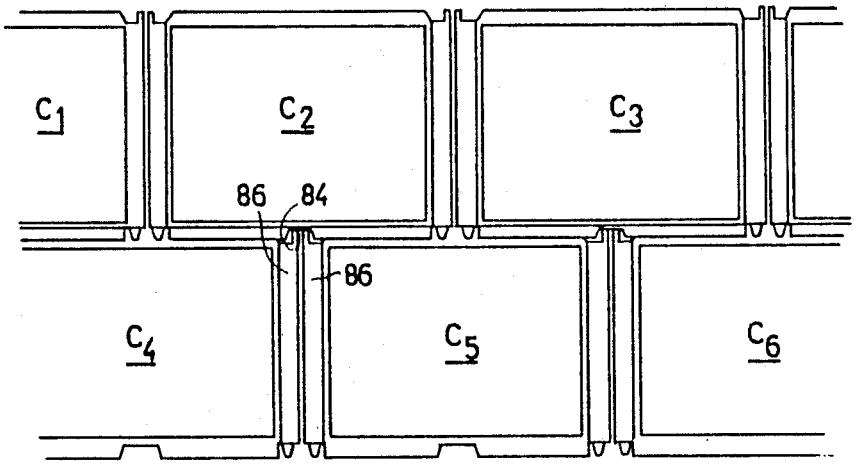
FIG. 10 is a side elevational view illustrating the manner of stacking a plurality of of like containers in staggered relationship.

Such a stacking arrangement is illustrated in FIG. 10, wherein it will be seen that containers $C_1$–$C_3$ of the overlying layer are applied over the containers $C_4$–$C_6$ of the underlying layer with the lower recesses 84 of the end walls of the overlying layer straddling the upper ribs 86 in the side walls of two adjacent containers in the underlying layer.

While the invention has been described with respect to one preferred embodiment, it will be appreciated that many other variations, modifications and applications of the invention may be made.

What is claimed is:

1. A collapsible plastic container, comprising:

a pair of side walls of plastic material formed with a plurality of air-circulation openings therethrough;

a pair of end walls of plastic material formed with a plurality of air-circulation openings therethrough;

hinges mounting each end wall between a pair of side walls to form a container in which said walls are hinged for movement either to an open condition wherein said walls are disposed perpendicularly to each other to form a container of rectangular configuration, or to a collapsed condition wherein said walls are folded on top of each other for storage or transportation;

each of said walls including internally-extending bottom ledges;

and a bottom wall of plastic material formed with a plurality of air-circulation openings therethrough supported on said bottom ledges in the open condition of the container so as to rigidify the container, said bottom wall being removable from said ledges to permit collapse of the container;

at least one of contiguous side and end walls being integrally formed at one end with a laterally-extending retainer tongue, and the other contiguous wall being formed with a retainer member having a slot adapted to releasably receive said retainer tongue in the open condition of the container to retain said walls in their open condition until said bottom wall is applied over said bottom ledges.

2. The container according to claim 1, wherein said retainer tongue includes a cam face yieldingly engageing the edge of the slot in the retainer member during the movement of the two respective walls to their open condition, and a shoulder which is snapped into engagement behind the edge of the slot in the respective retainer member when the two walls have reached their open condition.

3. The container according to claim 1, wherein at least some of said bottom ledges are formed with slots, and each side of said bottom wall is formed with a plurality of downwardly-extending ribs received in said slots.

4. The container occording claim 1, wherein each of said side and end walls are formed with:

an upper series of air-circulation openings configured and dimensioned to impart high rigidity to the upper end of the wall;

a lower series of air-circulation openings configured and dimensioned to impart less rigidity to the lower end of the wall;

and an intermediate series of air-circulation openings configured and dimensioned to impart even less rigidity to the intermediate portion of the wall.

5. A container according to claim 1, wherein each of said hinges including a hinge socket integrally formed in the side and end walls, and a hinge pin received in the hinge sockets of each pair of contiguous walls.

6. The container according to claim 5, wherein each of said hinge pins is formed with an enlarged head at one end engageable with one side of the respective hinge socket, the opposite end of each hinge pin being tapered for passing same through the hinge sockets of the contiguous walls, said tapered end of the hinge pin terminating in an annular shoulder engageable with the opposite end of the hinge sockets.

7. The container according to claim 6, wherein each of said hinge pins is formed with a slot beginning at a point between the tip of the tapered end of the hinge pin and said annular shoulder thereof, and extending past said annular shoulder, to increase the resiliency of said tapered end of the hinge pin when inserted into said hinge sockets.

8. The container according to claim 1, wherein said side, end, and bottom walls are further integrally formed with strengthening ribs.

9. The container according to claim 1, wherein: the upper ends of said side and end walls are formed with an upstanding rib extending the length thereof; and the lower ends of said side and end walls are formed with recesses adapted to accomodate the ribs of a pair of containers in order to permit a plurality of like containers to be stacked on top of each other in a plurality of layers with the containers of each layer straddling a pair of containers of the underlying layer, and with the ribs of the underlying layer received in the recesses of the overlying layer to stabilize the stack.

10. The container according to claim 1, wherein the end wall are formed with large openings at their upper ends dimensioned and configured to serve as hand grips.

* * * * *